US008626043B2

(12) United States Patent
Okamoto et al.

(10) Patent No.: US 8,626,043 B2
(45) Date of Patent: Jan. 7, 2014

(54) IMAGE FORMING APPARATUS AND TRANSFER DEVICE

(75) Inventors: Tetsuji Okamoto, Ebina (JP); Atsushi Ogihara, Ebina (JP); Koichi Watanabe, Ebina (JP); Shuichi Nishide, Ebina (JP); Wataru Suzuki, Ebina (JP); Atsuyuki Kitamura, Ebina (JP); Masahiro Sato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 232 days.

(21) Appl. No.: 13/296,783

(22) Filed: Nov. 15, 2011

(65) Prior Publication Data

US 2012/0230739 A1 Sep. 13, 2012

(30) Foreign Application Priority Data

Mar. 9, 2011 (JP) ..... 2011-052094

(51) Int. Cl.
*G03G 15/01* (2006.01)

(52) U.S. Cl.
USPC ..... 399/304; 399/305; 101/246; 101/415.1

(58) Field of Classification Search
USPC ..... 399/304, 305; 101/246, 415.1
See application file for complete search history.

(56) References Cited

U.S. PATENT DOCUMENTS 4,072,412 A * 2/1978 Suda et al. ..... 399/304
6,729,235 B2 * 5/2004 Kerr ..... 101/415.1

FOREIGN PATENT DOCUMENTS

JP 63-293573 A 11/1988
JP 7-271206 A 10/1995

* cited by examiner

*Primary Examiner* — David Gray
*Assistant Examiner* — Michael Harrison
(74) *Attorney, Agent, or Firm* — Sughrue Mion, PLLC

(57) ABSTRACT

An image forming apparatus includes: an image carrier that is rotatably arranged and carries an image on an outer circumferential surface thereof; a transfer member that is rotatably arranged to face the image carrier and transfers the image carried on the image carrier onto a sheet held between the transfer member and the image carrier; a leading edge gripping member that is secured to the transfer member and grips a leading edge side of the sheet in a transport direction thereof on an outer circumferential surface of the transfer member; and a trailing edge holding member that is arranged to be rotatable around the transfer member, holds a trailing edge side of the sheet in the transport direction thereof between the trailing edge holding member and the outer circumferential surface of the transfer member, and bends to release the trailing edge side of the sheet in the transport direction thereof.

5 Claims, 9 Drawing Sheets

IMAGE FORMING APPARATUS AND TRANSFER DEVICE

CROSS REFERENCE TO RELATED APPLICATIONS

This application is based on and claims priority under 35 USC §119 from Japanese Patent Application No. 2011-052094 filed Mar. 9, 2011.

BACKGROUND

1. Technical Field

The present invention relates to an image forming apparatus and a transfer device.

2. Related Art

There is known an image forming apparatus or a transfer device in which a sheet is wrapped around a transfer unit to transfer a toner image onto the sheet. Further, there is an image forming apparatus or a transfer device including a gripper for holding a sheet to be wrapped around a transfer unit.

SUMMARY

According to an aspect of the present invention, there is provided an image forming apparatus including: an image carrier that is rotatably arranged and carries an image on an outer circumferential surface thereof; a transfer member that is rotatably arranged to face the image carrier and transfers the image carried on the image carrier onto a sheet held between the transfer member and the image carrier; a leading edge gripping member that is secured to the transfer member and grips a leading edge side of the sheet in a transport direction thereof on an outer circumferential surface of the transfer member, the sheet being supplied toward the transfer member; and a trailing edge holding member that is arranged to be rotatable around the transfer member, holds a trailing edge side of the sheet in the transport direction thereof between the trailing edge holding member and the outer circumferential surface of the transfer member, the sheet being supplied toward the transfer member, and bends to release the trailing edge side of the sheet, which has been held, in the transport direction thereof.

BRIEF DESCRIPTION OF THE DRAWINGS

An exemplary embodiment of the present invention will be described in detail based on the following figures, wherein.

DETAILED DESCRIPTION

The exemplary embodiment will be described in detail with reference to the accompanying drawings.

<Entire Configuration of Image Forming Apparatus 1>

Figure 1:
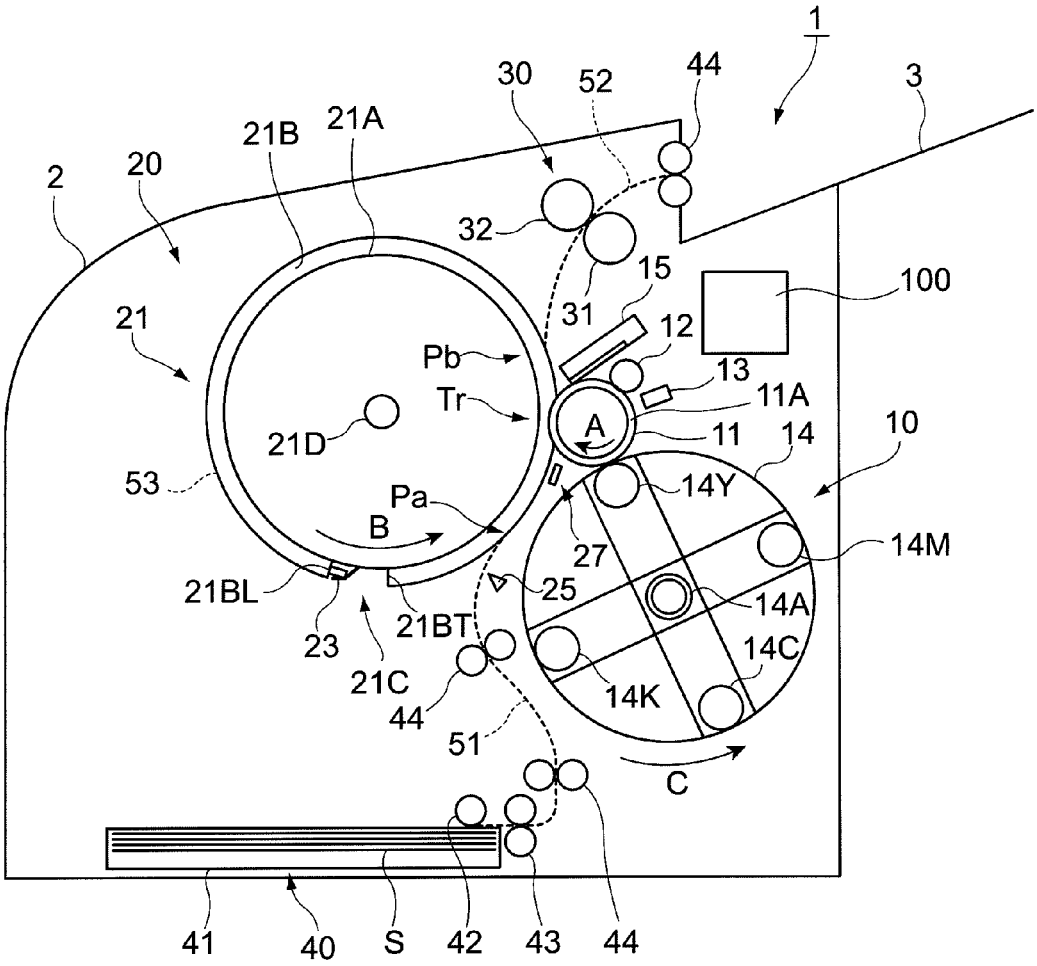
FIG. 1 is a schematic configuration diagram showing an image forming apparatus according to the exemplary embodiment.
Figure 2A:
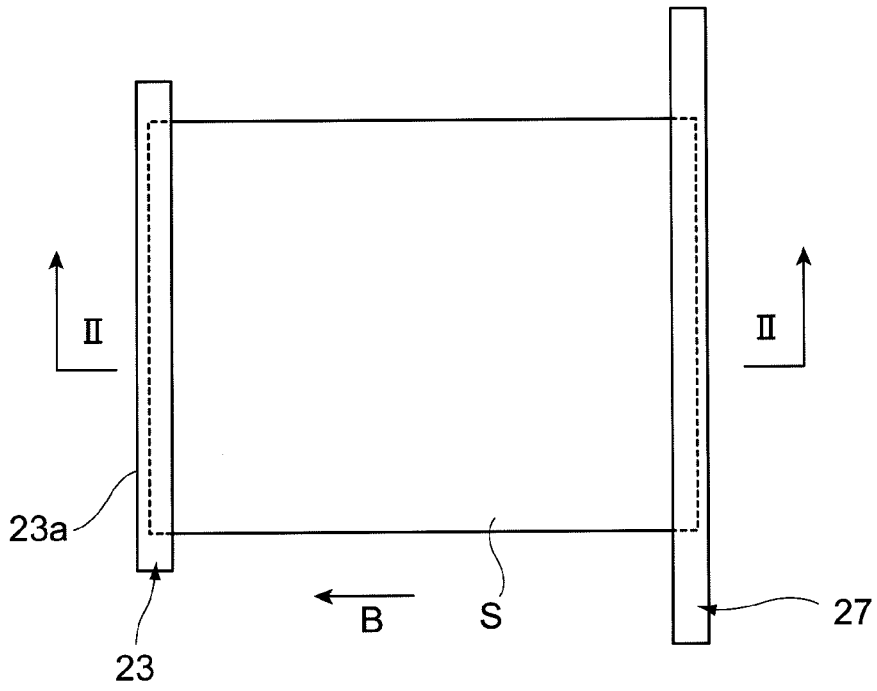
FIGS. 2A and 2B are diagrams for illustrating a relation between a sheet and each of a leading edge gripper and a trailing edge gripper according to the exemplary embodiment.
Figure 2B:
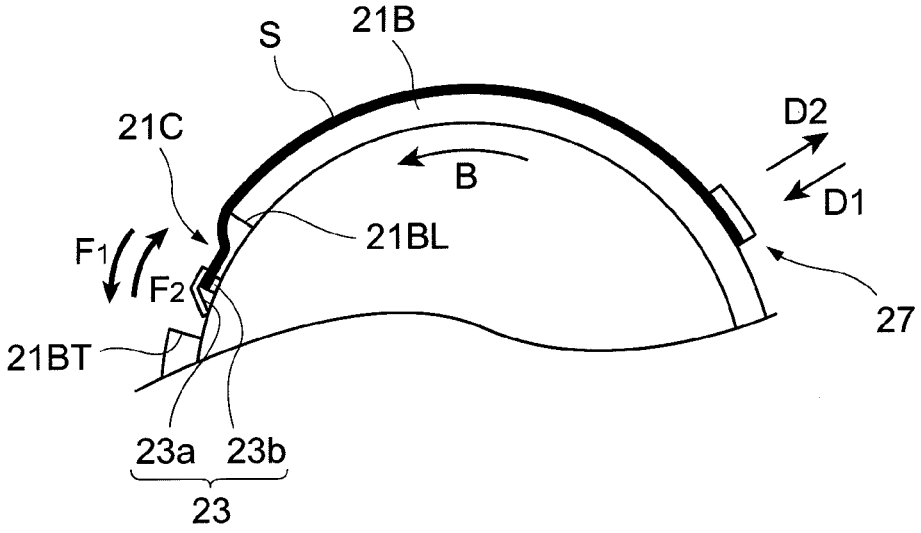
Figure 3:
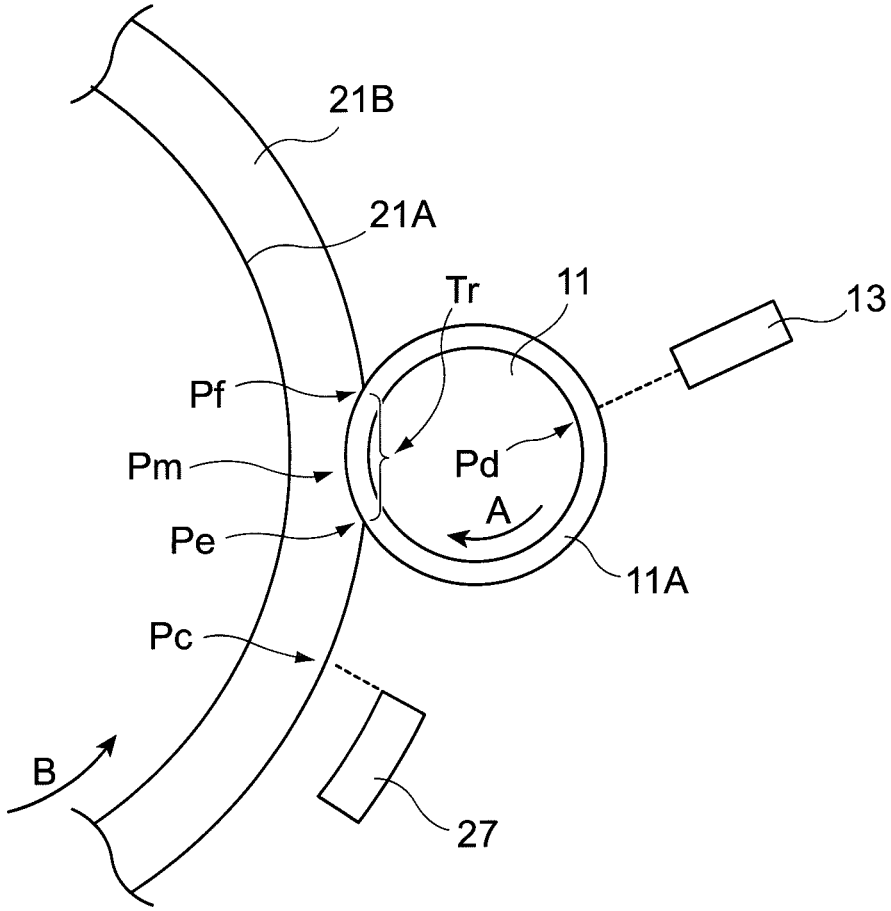
FIG. 3 is a schematic configuration diagram for illustrating a periphery of a transfer location according to the exemplary embodiment.

First, with reference to FIGS. 1 to 3, each configuration of an image forming apparatus 1 to which the exemplary embodiment is applied will be described. Here, FIG. 1 is a schematic configuration diagram showing the image forming apparatus 1 to which the exemplary embodiment is applied. FIGS. 2A and 2B are schematic diagrams for illustrating a relation between a sheet S and each of a leading edge gripper 23 and a trailing edge gripper 27 according to the exemplary embodiment: FIG. 2A is a diagram showing the leading edge gripper 23 and the trailing edge gripper 27 that retain the sheet S as viewed from the outside of the image forming apparatus 1; and FIG. 2B is a cross-sectional view of the leading edge gripper 23 and the trailing edge gripper 27 that retain the sheet S as viewed in the direction of arrow II in FIG. 2A. FIG. 3 is a schematic configuration diagram for illustrating a periphery of a transfer location Tr.

As shown in FIG. 1, the image forming apparatus 1 includes: an image forming unit 10 that forms a toner image; a sheet supply unit 40 that supplies and transports the sheet S (recording medium); and a transfer device 20 that holds the supplied sheet S and transfers the toner image formed in the image forming unit 10 onto the sheet S which has been held. The image forming apparatus 1 also includes a fixing device 30 that fixes the toner image on the sheet S released from the transfer device 20, and a controller 100 that controls the image forming apparatus 1 as a whole. Further, each component member of the image forming apparatus 1 is contained in a housing 2, and an output sheet stacking unit 3 that stacks the sheets S outputted from the fixing device 30 is provided in an upper portion of the housing 2.

<Configuration of Each Member>

As shown in FIG. 1, the image forming unit 10 includes a photoconductive drum 11. The image forming unit 10 further includes: a charging device 12 that charges the photoconductive drum 11; an exposure device 13 that exposes the photoconductive drum 11 which has been charged; a rotary developing device 14 that performs developing by use of developer; and a cleaning device 15 that cleans the developer remaining on the photoconductive drum 11. Hereinafter, each member will be described.

The photoconductive drum 11 as an example of an image carrier includes a photoconductive layer 11A having negative charging polarity on the surface thereof, and is attached to rotate in the direction of arrow A. The charging device 12, the exposure device 13, the rotary developing device 14 and the cleaning device 15 are provided around the photoconductive drum 11 along the direction of arrow A in this order. Here, the outer diameter of the photoconductive drum 11 is, for example, 30 mm.

The charging device 12 is, in the exemplary embodiment, a discharge device of a contact roller type, and charges the photoconductive drum 11 while rotating with the photoconductive drum 11.

The exposure device 13 forms an electrostatic latent image by irradiating the charged surface of the photoconductive drum 11.

The rotary developing device 14 includes a rotational axis 14A and developing units 14Y, 14M, 14C and 14K for yellow (Y), magenta (M), cyan (C) and black (K), respectively, which are provided around the rotational axis 14A. The rotary developing device 14 is detachably attached to the housing 2. Further, the rotary developing device 14 rotates in the direction of arrow C around the rotational axis 14A.

The rotary developing device 14 is configured such that any one of the developing units 14Y, 14M, 14C and 14K stops at a developing position which faces the photoconductive drum 11. The rotary developing device 14 is also configured to develop the electrostatic latent image on the photoconductive drum 11, which has been formed by the exposure device 13, by use of toner. The outer diameter of the rotary developing device 14 is, for example, 100 mm. It should be noted that, in the case where only a monochrome image, not a multicolor image, is to be formed, the rotary developing device 14 may be replaced with a developing device (not shown) having only a developing unit of monochrome color (for example, a developing unit 14K for black (K) only).

In these developing units 14Y, 14M, 14C and 14K, single component developer using magnetic toner or non-magnetic toner alone is contained. Here, the single component developer is used in the exemplary embodiment; however, two component developer containing toner and carrier may also be used. It should be noted that, hereinafter, the single component developer will be simply referred to as developer.

The cleaning device 15 is configured to remove the developer or adhering materials other than the developer remaining on the surface of the photoconductive drum 11. The cleaning device 15 in the exemplary embodiment is a cleaner of a blade type.

Next, the transfer device 20 will be described. The transfer device 20 has a transfer drum 21 that transfers the toner image on the photoconductive drum 11 onto the sheet S. The transfer device 20 also includes a leading edge gripper 23 that grips a leading edge portion of the sheet S on the transfer drum 21 and a trailing edge gripper 27 that holds a trailing edge portion of the sheet S on the transfer drum 21. Further, the transfer device 20 includes a sheet detecting sensor 25 that detects passage of the sheet S.

The transfer drum 21, which is an example of a transfer member, is arranged to face the photoconductive drum 11 and to be rotatable around a rotational axis 21D. The transfer device 20 is detachably attached to the housing 2. Further, the transfer drum 21 includes a drum-shaped base portion 21A and an elastic layer 21B formed on an outer circumferential surface of the base portion 21A.

The elastic layer 21B is provided along the outer circumference of the drum-shaped base portion 21A from a leading edge of the elastic layer 21BL (a leading edge of the outer circumferential surface of the transfer member), which is a leading edge in the transport direction of the sheet S, to a trailing edge of the elastic layer 21BT, which is a trailing edge in the transport direction of the sheet S. Further, the elastic layer 21B has a clearance between the trailing edge of the elastic layer 21BT and the leading edge of the elastic layer 21BL, which serves as an exposure portion (a cutout portion) 21C where the base portion 21A is exposed.

The transfer drum 21 forms a nip portion (a transfer location Tr, which will be described later) with the photoconductive drum 11 by contacting the photoconductive drum 11 and causing the elastic layer 21B to be elastically deformed. The transfer drum 21 is provided to rotate in the direction of arrow B. Here, each of a rotational axis (not shown) of the photoconductive drum 11 and the rotational axis 21D of the transfer drum 21 is secured to the image forming apparatus 1. In other words, the photoconductive drum 11 and the transfer drum 21 are arranged so that a distance between the rotational axes of the photoconductive drum 11 and the transfer drum 21 is maintained. Further, the exposure portion 21C of the transfer drum 21 does not contact the photoconductive drum 11. Moreover, the outer diameter of the transfer drum 21 is larger than that of the photoconductive drum 11, which is 120 mm, for example.

The base portion 21A in the exemplary embodiment is a hollow tube having conductivity and is made of metal, for example. On the other hand, the elastic layer 21B is an elastic member having semi-conductivity and is made of rubber such as polyurethane, chlororprene, EPDM (ethylene propylene rubber) and NBR (nitrile-butadiene rubber), for example.

Here, a dielectric material such as a dielectric sheet is not provided on an outer circumferential surface of the elastic layer 21B. Further, the transfer drum 21 is not provided with a charger such as a corotron for performing electrostatic absorption of the sheet S. That is to say, the transfer drum 21 does not utilize so-called electrostatic absorption to hold the sheet S.

Further, the circumferential length of the transfer drum 21 (more specifically, the circumferential length of the elastic layer 21B) is longer than the maximum length of the image formed on the sheet S by the image forming apparatus 1 in the transport direction of the sheet S (maximum printing length).

A transfer bias, which is a voltage having an opposite polarity to toner, is applied from a high-voltage power supply (not shown) to the base portion 21A. This is a configuration in which toner constituting the toner image on the photoconductive drum 11 is transferred onto the sheet S on the elastic layer 21B at the transfer location Tr.

It should be noted that the transfer location Tr refers to a region where the toner image on the photoconductive drum 11 is transferred onto the sheet S on the elastic layer 21B, and a region where the elastic layer 21B (or the sheet S on the elastic layer 21B) contacts the transfer drum 21.

More specifically, as shown in FIG. 3, the transfer location Tr is a range from a contact starting point Pe to a contact finishing point Pf via a maximum compressing point Pm. In other words, if a specific point on the elastic layer 21B of the transfer drum 21 is assumed, as the transfer drum 21 rotates, the point starts to contact the photoconductive drum 11 at the contact starting point Pe and finishes the contact with the photoconductive drum 11 at the contact finishing point Pf. Further, when the specific point is on the maximum compressing point Pm, the elastic layer 21B is compressed by the photoconductive drum 11 to have a minimum thickness.

Further, as shown in FIG. 3, a position facing a standby position where the trailing edge gripper 27 is on standby (later described) is supposed to be a position Pc. Moreover, a position where the exposure device 13 performs exposure is supposed to be a position Pd.

Then, in FIG. 3, the distance on the outer circumference of the transfer drum 21 from the position Pc to the contact starting point Pe (in the direction of arrow B) is shorter than the distance on the outer circumference of the transfer drum 21 from the position Pd to the contact starting point Pe (in the direction of arrow A).

The standby position of the trailing edge gripper 27 in the exemplary embodiment exists on the outer circumference of the transfer drum 21 and between a sheet supply position Pa and the transfer location Tr. As the standby position of the trailing edge gripper 27 comes closer to the transfer location Tr, misregistration of the image is suppressed.

Returning again to FIG. 1, each configuration of the image forming apparatus 1 will be described. It should be noted that the details of the leading edge gripper 23 and the trailing edge gripper 27 will be described later.

The sheet detecting sensor 25 is arranged to face a supply path 51 (later described) and detects passage of the sheet S transported on the supply path 51. More specifically, the sheet detecting sensor 25 emits near infrared light toward the supply path 51. Then the sheet detecting sensor 25 receives reflected light (near infrared light) from the sheet S transported on the supply path 51.

Further, the sheet detecting sensor 25 detects a mark (not shown) provided on the transfer drum 21, thus measuring a phase of the rotating transfer drum 21.

The fixing device 30 includes a heat roll 31 that has a heat source (not shown) and is rotatably arranged and a pressure roll 32 that is brought into pressure contact with the heat roll 31.

The sheet supply unit 40 includes: a sheet container 41 that is provided at a lower part in the image forming apparatus 1, specifically, below the transfer drum 21, and contains sheets S inside thereof; a sheet size sensor (not shown) that is provided in the feed roll 42 and detects the size of the sheet S contained in the sheet container 41; the feed roll 42 that draws out the sheet S from the sheet container 41; a retard roll 43 that separates sheets S that are in intimate contact with each other; and transport rolls 44 that transport the sheet S.

The controller 100 receives an input of a signal via a user interface (not shown) that receives instructions from a user. The controller 100 also receives an input of an image signal from an image output instruction unit (not shown) provided inside or outside of the image forming apparatus 1. Further, the controller 100 receives an input of a signal indicating passage of the sheet S and a phase signal of the transfer drum 21 that are transmitted from the sheet detecting sensor 25.

The controller 100 is configured to output a control signal to each of the following components. That is, the controller 100 outputs a control signal to each of: a photoconductive drum driving unit (not shown) that rotationally drives the photoconductive drum 11; the charging device 12; the exposure device 13; a developing device driving unit (not shown) that rotates and stops the rotary developing device 14 to locate a target unit, which is one of the developing units 14Y, 14M, 14C and 14K, at the developing position facing the photoconductive drum 11; a developing bias setting unit (not shown) that sets a developing bias to be supplied to one of the developing units 14Y, 14M, 14C and 14K arranged at the developing position; a transfer drum driving unit (not shown) that rotationally drives the transfer drum 21; a trailing edge gripper driving unit (not shown) that rotationally drives the trailing edge gripper 27; a transfer bias setting unit (not shown) that sets a transfer bias to be supplied to the transfer drum 21; the leading edge gripper 23; the trailing edge gripper 27; the sheet supply unit 40; and the fixing device 30.

Here, the image forming apparatus 1 includes: the supply path 51 for supplying sheet S to the transfer location Tr from the sheet container 41; and an exit path 52 for outputting the sheet S onto which the toner image is transferred to the output sheet stacking unit 3 via the fixing device 30. Further, in the exemplary embodiment, the sheet S supplied toward the transfer drum 21 is rotated while being wrapped around the transfer drum 21 by the leading edge gripper 23 and the trailing edge gripper 27, and a path on which the sheet S passes is referred to as a rotation path 53.

<Leading Edge Gripper 23 and Trailing Edge Gripper 27>

Figure 4:
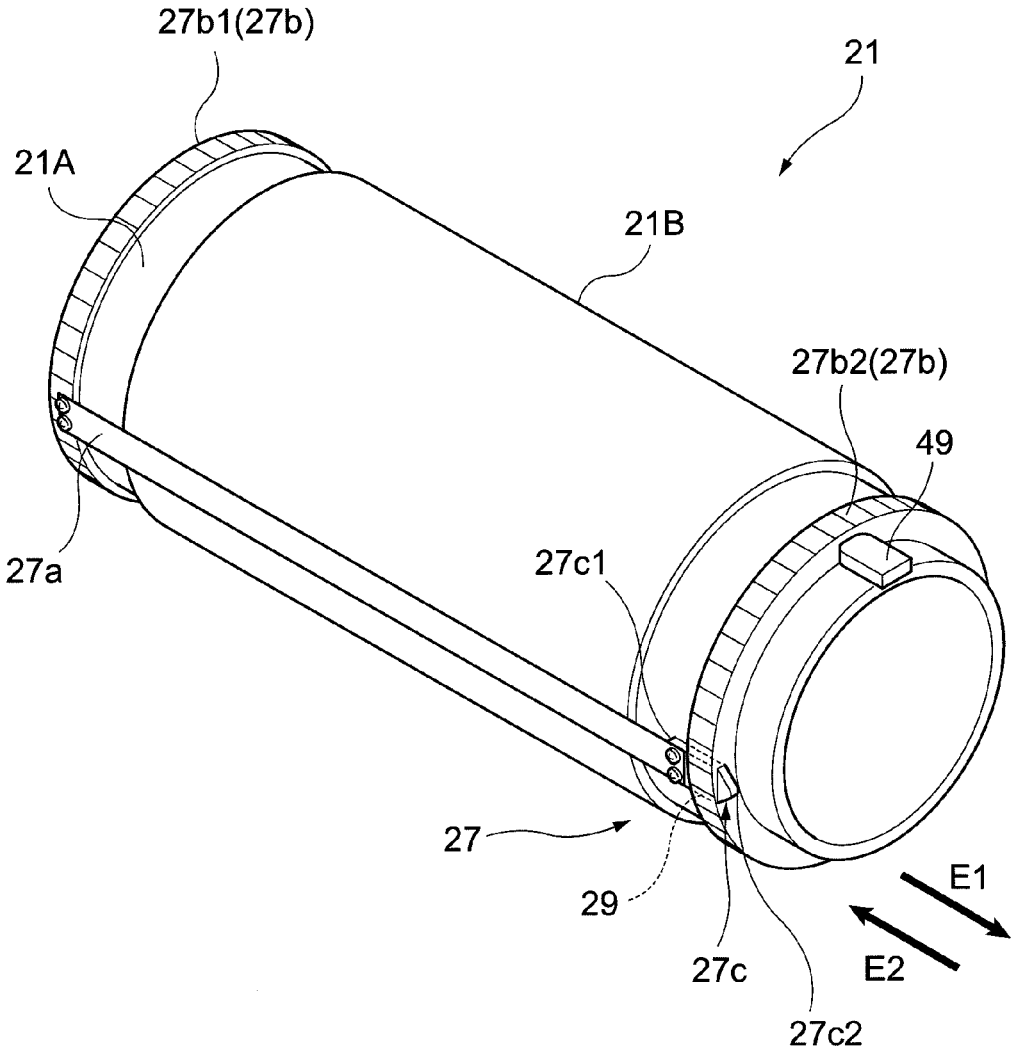
FIG. 4 is a schematic configuration diagram showing the trailing edge gripper according to the exemplary embodiment.

Next, with reference to FIGS. 1 to 4, configuration of the leading edge gripper 23 and the trailing edge gripper 27 will be described. Here, FIG. 4 is a schematic configuration diagram showing the trailing edge gripper 27 according to the exemplary embodiment.

First, each of the leading edge gripper 23 and the trailing edge gripper 27 is openable and closable. The leading edge gripper 23 and the trailing edge gripper 27 are rotatable with the transfer drum 21. Further, the leading edge gripper 23 and the trailing edge gripper 27 are configured to hold the sheet S on the transfer drum 21.

Specifically, as shown in FIGS. 2A and 2B, the leading edge gripper 23 grips the leading edge portion in the transport direction of the sheet S on the transfer drum 21 (arrow B) (the left end portion of the sheet S in FIGS. 2A and 2B) and the trailing edge gripper 27 holds the trailing edge portion in the transport direction of the sheet S on the transfer drum 21 (arrow B) (the right end portion of the sheet S in FIGS. 2A and 2B).

Here, the leading edge gripper 23 is secured to the transfer drum 21 (refer to FIG. 1). The trailing edge gripper 27, on the other hand, rotates around the rotational axis 21D (refer to FIG. 1) independently of the transfer drum 21 and the position of the trailing edge gripper 27 can be changed with respect to the transfer drum 21.

Hereinafter, configuration of each of the leading edge gripper 23 and the trailing edge gripper 27 will be described in this order.

<Leading Edge Gripper 23>

First, as shown in FIG. 2B, the leading edge gripper 23, which is an example of a leading edge gripping member, is attached to the exposure portion 21C of the transfer drum 21. The leading edge gripper 23 is configured not to contact the photoconductive drum 11 as described later.

Moreover, the leading edge gripper 23 includes an outside member 23*a* that retains the sheet S from the outside with respect to the center of the rotation of the transfer drum 21 and an inside member 23*b* that retains the sheet S from the inside with respect to the center of the rotation of the transfer drum 21. The leading edge gripper 23 sandwiches the sheet S by the outside member 23*a* and the inside member 23*b*.

As shown in FIG. 2A, the outside member 23*a* is a plate-like member and is arranged so that the longitudinal direction thereof is along the rotational axis 21D (refer to FIG. 1) of the transfer drum 21. The outside member 23*a* is made of metal such as stainless steel (SUS).

Further, as shown in FIG. 2B, since one end of the outside member 23*a* rotates around the other end thereof (refer to arrows F1 and F2), the one end of the outside member 23*a* moves forward or backward with respect to the inside member 23*b*.

The inside member 23*b* is a plate-like member, and is arranged to be along the outside member 23*a*.

The inside member 23*b* is secured to the transfer drum 21, and is arranged inside of the outside member 23*a* with respect to the center of the rotation of the transfer drum 21 in the state where the leading edge gripper 23 is closed.

<Trailing Edge Gripper 27>

Next, with reference to FIGS. 1, 2A, 2B and 4, configuration of the trailing edge gripper 27 will be described.

As shown in FIGS. 1 and 4, the trailing edge gripper 27 is attached to cover the transfer drum 21 in the direction of the rotational axis 21D of the transfer drum 21. Further, the trailing edge gripper 27 opens and closes by being pressed toward the direction along the rotational axis 21D of the transfer drum 21 (details will be described later).

<Each Member of the Trailing Edge Gripper 27>

As shown in FIG. 4, the trailing edge gripper 27, which is an example of a trailing edge holding member, includes a sheet restriction unit 27*a* that faces the outer circumferential surface of the transfer drum 21 and restricts movement of the sheet S. The trailing edge gripper 27 further has a rotating unit 27*b* that holds both end portions of the sheet restriction unit 27*a* and rotates around the rotational axis 21D (refer to FIG. 1) of the transfer drum 21. Still further, the trailing edge gripper 27 includes an operating piece 27*c* that is provided between the sheet restriction unit 27*a* and the rotating unit 27*b*, and moves along the rotational axis 21D of the transfer drum 21.

<Sheet Restriction Unit 27*a*>

As shown in FIG. 4, the sheet restriction unit 27*a* is a plate-like member and is arranged so that the longitudinal direction thereof is along the rotational axis 21D (refer to FIG. 1) of the transfer drum 21. Moreover, as shown in FIG. 4, the sheet restriction unit 27*a* is longer than the width of the elastic layer 21B (length in the direction along the rotational axis 21D of the transfer drum 21).

Further, the sheet restriction unit 27*a* is made of a resin such as PET (polyethylene terephthalate), polyimide and fluorine, and is thus capable of being elastically deformed. The sheet restriction unit 27*a* has rigidity of the extent to which the sheet restriction unit 27*a* is able to bend by being pressed in the longitudinal direction thereof.

Here, since the sheet restriction unit 27*a* contacts the photoconductive drum 11 at the transfer location Tr (will be described later), the sheet restriction unit 27*a* causes damage to the photoconductive drum 11 in some cases depending on the shape of the sheet restriction unit 27*a*. In the exemplary embodiment, the sheet restriction unit 27*a* has a small thickness and chamfered edges.

It should be noted that the sheet restriction unit 27*a* in the exemplary embodiment is a plate-like member as described above; however, the sheet restriction unit 27*a* may be in the shape of a film, a wire, a circular cylinder or the like.

<Rotating Unit 27*b*>

As shown in FIG. 4, the rotating unit 27*b* is constituted by a first rotating unit 27*b*1 and a second rotating unit 27*b*2, which are two ring-shaped members. The first rotating unit 27*b*1 and the second rotating unit 27*b*2 are provided to respective both end portions of the transfer drum 21 coaxially with the transfer drum 21.

The first rotating unit 27*b*1 and the second rotating unit 27*b*2 are rotatable in synchronization with each other around the transfer drum 21. The first rotating unit 27*b*1 and the second rotating unit 27*b*2 in the exemplary embodiment are gears. The rotating unit 27*b* rotates upon receiving a driving force from a drive source not shown in the figure.

The first rotating unit 27*b*1 and the second rotating unit 27*b*2 hold respective both ends of the sheet restriction unit 27*a*. In the exemplary embodiment, one end portion of the sheet restriction unit 27*a* is connected to the first rotating unit 27*b*1, and the other end portion of the sheet restriction unit 27*a* is connected to the second rotating unit 27*b*2 via the operating piece 27*c*. Here, a through hole 29 into which the operating piece 27*c* is inserted is formed in the second rotating unit 27*b*2.

<Operating Piece 27*c*>

As shown in FIG. 4, the operating piece 27*c* is a plate-like member. The operating piece 27*c* is inserted into the through hole 29 formed in the second rotating unit 27*b*2, and is provided to be movable along the axis direction of the transfer drum 21 (refer to arrows E1 and E2). Further, the operating piece 27*c* is in the state of at least protruding toward the outside of the transfer drum 21 from the second rotating unit 27*b*2. Still further, the operating piece 27*c* is urged toward the outside (refer to arrow E1) of the transfer drum 21 by a spring member (not shown).

Here, in the operating piece 27*c*, an end portion facing the inside of the transfer drum 21 (an end portion facing the elastic layer 21B) is referred to as an inside end portion 27*c*1. On the other hand, in the operating piece 27*c*, an end portion opposite to the inside end portion 27*c*1, namely, an end portion facing the outside of the transfer drum 21 is referred to as an outside end portion 27*c*2.

The inside end portion 27*c*1 is connected to the sheet restriction unit 27*a*. On the other hand, in the outside end portion 27*c*2, an inclination is provided by which the operating piece 27*c* is pressed toward the inside (refer to arrow E2) of the transfer drum 21 upon contacting a claw unit 49 (described later) with the rotation of the trailing edge gripper 27.

<Claw Unit 49>

Though explanation is omitted in the above description, the image forming apparatus 1 (refer to FIG. 1) includes the claw unit 49 around the transfer drum 21 to press the operating piece 27*c* of the trailing edge gripper 27. The claw unit 49 presses the operating piece 27*c* of the trailing edge gripper 27, thereby opening the trailing edge gripper 27.

The claw unit 49 in the exemplary embodiment is secured to the housing 2. The claw unit 49 is provided at a position to be brought into contact with the operating piece 27*c* of the trailing edge gripper 27 rotating around the transfer drum 21.

To be further described, the claw unit 49 is provided at a position where the claw unit 49 is brought into contact with the outside end portion 27*c*2 of the operating piece 27*c* in the trailing edge gripper 27 when the trailing edge gripper 27 is arranged at the standby position. As described above, the inclination is provided on the outside end portion 27*c*2, and the operating piece 27*c* of the trailing edge gripper 27, which is in contact with the claw unit 49, comes into a state of being pressed toward the inside of the transfer drum 21 (refer to arrow E2) (a state of being hidden in the second rotating unit 27*b*2).

<Opened and Closed States of Trailing Edge Gripper 27>

Figure 5A:
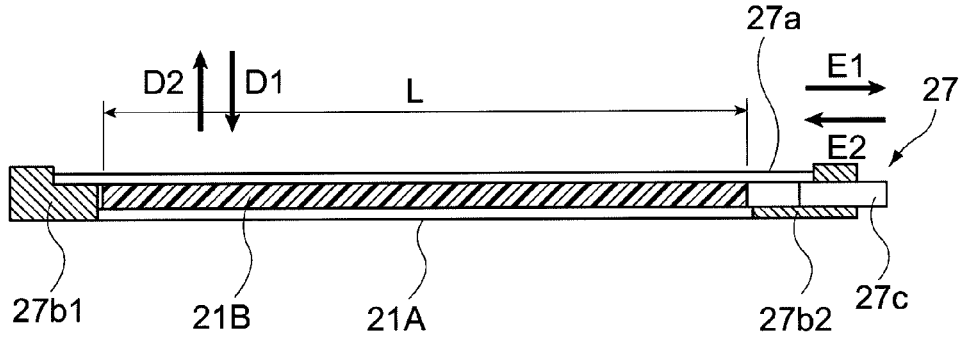
FIGS. 5A and 5B are schematic configuration diagrams for illustrating opened and closed states of the trailing edge gripper according to the exemplary embodiment.
Figure 5B:
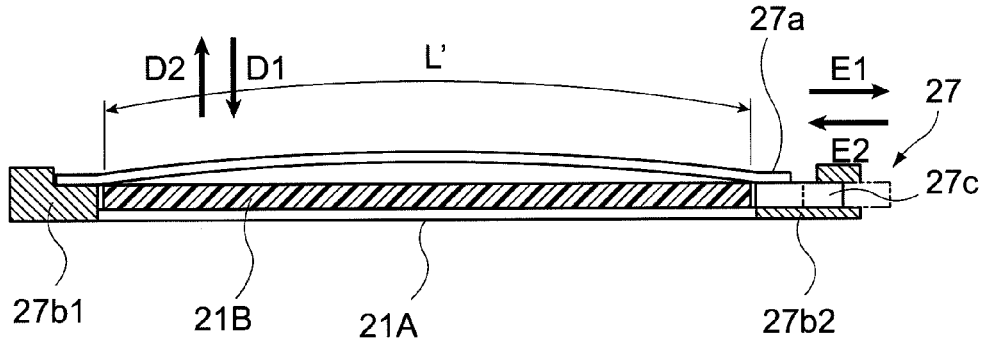

Here, with reference to FIGS. 5A and 5B, the state where the trailing edge gripper 27 is opened or closed will be described. Here, FIGS. 5A and 5B are schematic configuration diagrams for illustrating opened and closed states of the trailing edge gripper 27 according to the exemplary embodiment. Specifically, FIG. 5A is a schematic configuration diagram showing the closed trailing edge gripper 27, and FIG. 5B is a schematic configuration diagram showing the opened trailing edge gripper 27.

First, the closed state of the trailing edge gripper 27 will be described with reference to FIG. 5A. In this state, the operating piece 27*c* is not in contact with the claw unit 49 (refer to FIG. 4), and is protruding from the second rotating unit 27*b*2. The sheet restriction unit 27*a* that is connected to the operating piece 27*c* is in the state of being pulled by the operating piece 27*c*. At this time, a gap between the sheet restriction unit 27*a* and the elastic layer 21B is small.

Next, the opened state of the trailing edge gripper 27 will be described with reference to FIG. 5B. In this state, the operating piece 27*c* is pressed toward the inside of the transfer drum 21 (refer to arrow E2) by the claw unit 49 (refer to FIG. 4). Then, the sheet restriction unit 27*a* connected to the inside end portion 27*c*1 of the pressed operating piece 27*c* receives a compressing force in the longitudinal direction.

Upon receiving the compressing force, as shown in FIG. 5B, the sheet restriction unit 27*a* is put into a state of bending in a direction away from the elastic layer 21B due to the resiliency of the sheet restriction unit 27*a*. At this time, the gap between the sheet restriction unit 27*a* and the elastic layer 21B is large. Further, in the state where the trailing edge gripper 27 is opened, the leading edge gripper 23 holding the sheet S is able to pass through the gap between the sheet restriction unit 27*a* and the elastic layer 21B.

Here, in the longitudinal direction of the sheet restriction unit 27*a*, the length of the part of the sheet restriction unit 27*a* within a region where the elastic layer 21B exists (the length of the part of the sheet restriction unit 27*a* that exists above the elastic layer 21B in FIGS. 5A and 5B, refer to L and L' in the figures) will be described.

As described above, in the closed trailing edge gripper 27 shown in FIG. 5A, the sheet restriction unit 27*a* is in the state of being pulled, whereas, in the opened trailing edge gripper 27 shown in FIG. 5B, the sheet restriction unit 27*a* is in the state of bending. Consequently, the length L' of the part of the sheet restriction unit 27*a* within the region where the elastic layer 21B exists in the state where the trailing edge gripper 27 is opened is longer than the length L of the part of the sheet restriction unit 27*a* within the region where the elastic layer 21B exists in the state where the trailing edge gripper 27 is closed.

In the exemplary embodiment, the member that moves in the direction of the diameter (the vertical direction in FIGS. 5A and 5B) of the transfer drum 21 (refer to FIG. 1) along with opening or closing of the trailing edge gripper 27 is the sheet restriction unit 27*a* alone. To be described further, even though the trailing edge gripper 27 is opened or closed, the position of the end portion of the sheet restriction unit 27*a* is not changed in the direction of the diameter of the transfer drum 21.

<Operation of Image Forming Apparatus 1>

Figure 6:
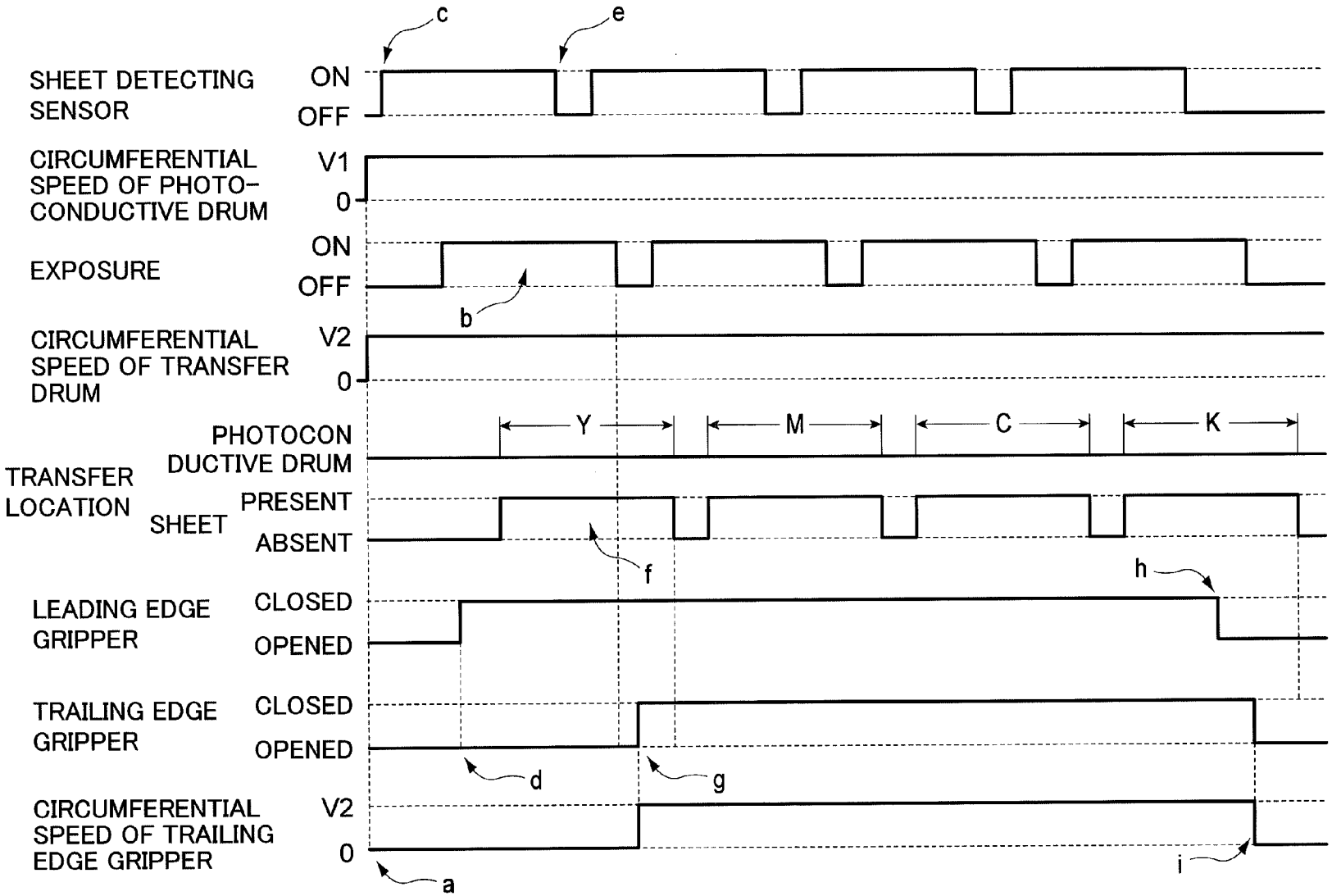
FIG. 6 is a timing chart in a recorded image forming operation according to the exemplary embodiment.

Next, with reference to FIGS. 1, 6 and 7A to 7D, operation of the entire image forming apparatus 1 will be described. It should be noted that the case where an image of plural colors is formed on the sheet S by the image forming apparatus 1 will be described here. FIG. 6 is a timing chart in a recorded image forming operation, and FIGS. 7A to 7D are diagrams for illustrating an operation in which the sheet S is wrapped around the transfer drum 21 in the exemplary embodiment.

First, a coloring material reflective light image of a document read by a document reader (not shown) or coloring material image data formed by a personal computer (not shown) or the like is inputted to an image signal processing device (not shown) as each data of red (R), green (G) and blue (B) color components, for example, to undergo predetermined image processing. The image data subjected to the image processing is converted into coloring material gradation data of four color components of yellow (Y), magenta (M), cyan (C) and black (K), and outputted to the exposure device 13 (refer to FIG. 1).

Figure 7A:
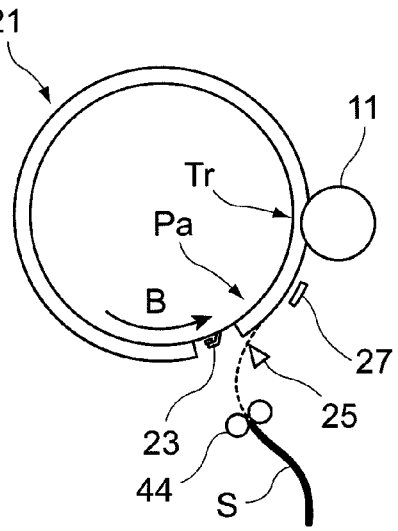
FIGS. 7A to 7D are diagrams for illustrating an operation in which a sheet is wrapped around a transfer drum in the exemplary embodiment.
Figure 7B:
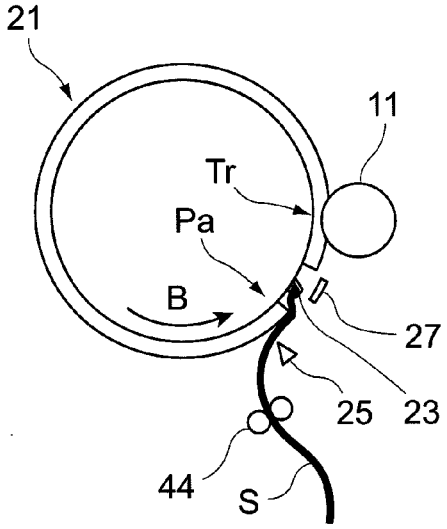
Figure 7C:
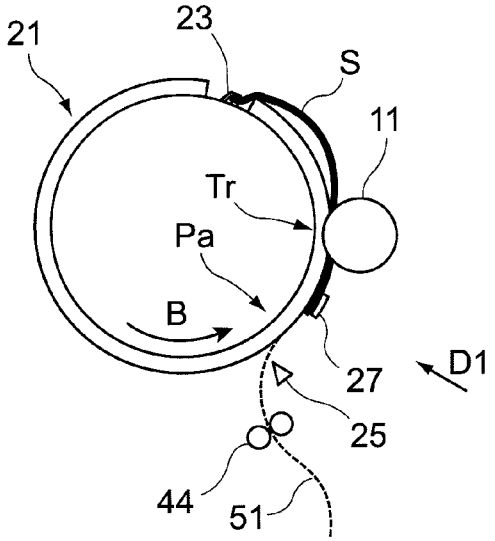
Figure 7D:
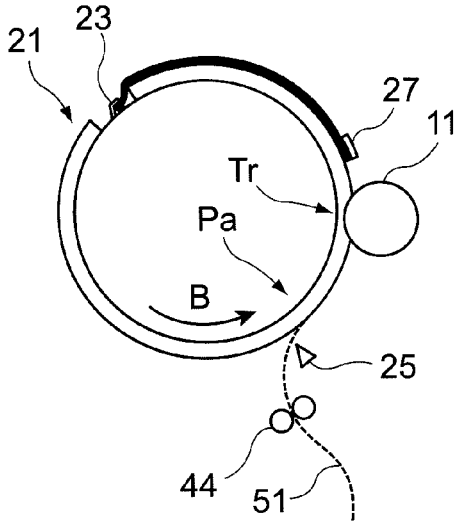

With the start of the recorded image forming operation, the photoconductive drum 11 and the transfer drum 21 (refer to FIG. 1) start to rotate in synchronization with each other (refer to FIG. 7A). At this time, both leading edge gripper 23 and trailing edge gripper 27 are opened (refer to arrow a in FIG. 6).

To be further described, at this time, the leading edge gripper 23 rotates with the transfer drum 21, whereas the trailing edge gripper 27 is at rest at the standby position (the circumferential speed is zero. Refer to arrow a in FIG. 6). The operating piece 27*c* of the trailing edge gripper 27 is in the state of being pressed toward the inside of the transfer drum 21 due to the contact with the claw unit 49 (refer to FIG. 4), and the sheet restriction unit 27*a* is in the state of bending in the direction away from the elastic layer 21B.

Then, as shown in FIG. 1, after the rotating photoconductive drum 11 is charged by the charging device 12, the electrostatic latent image of the first color (for example, yellow) according to image information is formed by the exposure device 13 (refer to arrow b in FIG. 6). Further, as the transfer drum 21 starts to rotate, the sheet detecting sensor 25 measures the phase of the transfer drum 21. The measured phase is transmitted to the controller 100.

On the other hand, in the rotary developing device 14, the developing unit containing toner of color component corresponding to the electrostatic latent image formed on the photoconductive drum 11 is rotated to be arranged at a position facing the photoconductive drum 11 and is stopped.

Then, the electrostatic latent image on the photoconductive drum 11 is developed by the developing unit 14Y, for example, to form the toner image on the photoconductive drum 11. With the rotation of the photoconductive drum 11, the toner image (here, the yellow toner image) is transported toward the transfer location Tr that faces the transfer device 20.

In response to the start of the recorded image forming operation, supply of the sheet S is also performed. Specifically, the sheet S is forwarded to the supply path 51 by use of the feed roll 42, the retard roll 43 and the transport rolls 44. Then the sheet detecting sensor 25 detects the passage of the leading edge in the transport direction of the sheet S (refer to arrow c in FIG. 6), and transmits a detection signal to the controller 100. Upon receiving the detection signal, the controller 100 controls the transport such that the sheet S reaches a sheet supply position Pa in step with the arrival of the leading edge gripper 23 at the sheet supply position Pa. It should be noted that, on the occasion of supplying the sheet S, the size of the sheet S that is detected by the sheet size sensor (not shown) is transmitted to the controller 100.

In step with the arrival of the end portion of the sheet S on the leading edge side in the transport direction at the sheet supply position Pa, the leading edge gripper 23 shifts from the opened state to the closed state (refer to arrow d in FIG. 6). As a consequence of this, the leading edge gripper 23 grips the leading edge in the transport direction of the sheet S (refer to FIG. 7B). It should be noted that the trailing edge gripper 27 is at rest at the standby position with its opened state (refer to arrow d in FIG. 6).

Thereafter, the leading edge gripper 23 gripping the sheet S passes between the sheet restriction unit 27*a* of the trailing edge gripper 27 at rest and the center of the rotation of the transfer drum 21 (passes the trailing edge gripper 27 at rest). The leading edge gripper 23 having passed between the trailing edge gripper 27 and the elastic layer 21B (refer to FIG. 3) further passes through the transfer location Tr while gripping the sheet S.

The sheet S, which has passed through the transfer location Tr with being gripped by the leading edge gripper 23 (refer to allow f in FIG. 6), comes to the state of wrapping around the transfer drum 21 while being gripped by the leading edge gripper 23, and is transported on the rotation path 53.

Then, after the electrostatic latent image of the first color (for example, yellow) according to the image information is formed by the exposure device 13, passage of the trailing edge in the transport direction of the sheet S is detected by the sheet detecting sensor 25 (refer to arrow e in FIG. 6). Upon receiving a signal from the sheet detecting sensor 25, the controller 100 provides instructions to the trailing edge gripper 27. When the instructions are received, the trailing edge gripper 27 starts to rotate in synchronization with the transfer drum 21 and shifts from the opened state to the closed state (refer to arrow g in FIG. 6).

Here, the operation in which the trailing edge gripper 27 shifts from the opened state to the closed state will be specifically described. First, with the start to rotate, the trailing edge gripper 27 moves away from the claw unit 49. Then the operating piece 27*c* moves toward the outside of the transfer drum 21 (refer to arrow E1 in FIG. 5B) since pressing by the claw unit 49 is canceled. With the movement of the operating piece 27*c*, the sheet restriction unit 27*a* approaches the outer circumferential surface of the transfer drum 21 (refer to arrow D1 in FIG. 5B). Accordingly, the trailing edge gripper 27 is closed to hold the trailing edge portion in the transport direction of the sheet S (refer to FIG. 7C).

Further, when the trailing edge gripper 27 is closed, the exposure device 13 has completed forming the electrostatic latent image of the first color (for example, yellow) and has not started yet to form the electrostatic latent image of the second color (for example, magenta). In short, when the electrostatic latent image is written (during exposure), operation of opening or closing of the trailing edge gripper 27 is not performed. Accordingly, disturbance of the electrostatic latent image due to opening or closing of the trailing edge gripper 27 is not caused.

The trailing edge gripper 27, which has started to rotate, rotates with the transfer drum 21 while holding the edge portion of the trailing edge side in the transport direction of the sheet S wrapped around the transfer drum 21. In other words, the sheet S rotates with the transfer drum 21 while the edge portion of the leading edge side in the transport direction thereof being gripped by the leading edge gripper 23 and the edge portion of the trailing edge side in the transport direction thereof being held by the trailing edge gripper 27 (refer to FIG. 7D).

It should be noted that, when passing through the transfer location Tr, the trailing edge gripper 27 holding the sheet S contacts the photoconductive drum 11, whereas the leading edge gripper 23 gripping the sheet S does not contact the photoconductive drum 11.

The toner image of the first color (for example, yellow) formed on the photoconductive drum 11 is transferred onto the sheet S on the transfer drum 21 at the transfer location Tr where the photoconductive drum 11 and the transfer drum 21 face each other. It should be noted that the toner remaining on the photoconductive drum 11 after transfer is removed by the cleaning device 15 (refer to FIG. 1).

Then, the electrostatic latent image formation, development and transfer of the second color to the color (for example, magenta or cyan) preceding the final color (for example, black) are similarly repeated according to the above-described procedures. When the toner image of each color is formed, the rotary developing device 14 rotates to arrange the corresponding developing unit 14M or 14C at the stop position.

In the meantime, the sheet S is rotated and transported in the state of being wrapped around the transfer drum 21 by the leading edge gripper 23 and the trailing edge gripper 27, and the toner images of the second and subsequent colors are sequentially transferred to be superimposed each time the sheet S passes through the transfer location Tr. As a result, in the formation of a full-color image, for example, each of the toner images of yellow (Y), magenta (M) and cyan (C), except black (K), is multiply-transferred onto the sheet S on the transfer drum 21.

Then, in the case where the toner image of the final color is transferred, different from the case of transferring the toner image of any color preceding the final color (for example, black), the leading edge gripper 23 disengages (releases) gripping of the sheet S. That is to say, the leading edge gripper 23 shifts from the closed state to the opened state (refer to arrow h in FIG. 6). Further, the sheet S, which has been released from gripping by the leading edge gripper 23, having a full-color image formed thereon is peeled from the transfer drum 21 at the leading edge in the transport direction thereof due to a nip between the elastic layer 21B and the photoconductive drum 11, thereby entering into the exit path 52 at a sheet exit position Pb.

Thereafter, as the sheet S is transported, the trailing edge gripper 27 holding the trailing edge in the transport direction of the sheet S arrives at the above-described standby position. At the standby position, the claw unit 49 (refer to FIG. 4) contacts and presses the operating piece 27*c*, and thereby the trailing edge gripper 27 shifts from the closed state to the opened state (refer to arrow D1 in FIG. 5A). Further, the trailing edge gripper 27 in the opened state is at rest at the standby position. That is, the trailing edge gripper 27 in the opened state does not rotate with the transfer drum 21, and the circumferential speed thereof becomes zero (refer to arrow i in FIG. 6).

It should be noted that, when the trailing edge gripper 27 shifts from the closed state to the opened state, the electrostatic latent image of the final color (for example, black) according to the image information has already been formed by the exposure device 13.

The trailing edge in the transport direction of the sheet S, which has been released from holding by the trailing edge gripper 27, is peeled from the transfer drum 21 and enters into the exit path 52 at the sheet exit position Pb.

The sheet S having entered into the exit path 52 is forwarded to the fixing device 30, and the toner image on the sheet S is fixed. The sheet S on which fixing has been finished is outputted to the outside of the image forming apparatus 1 by the transport rolls 44 and stacked in the output sheet stacking unit 3.

<Modified Example>

Figure 8A:
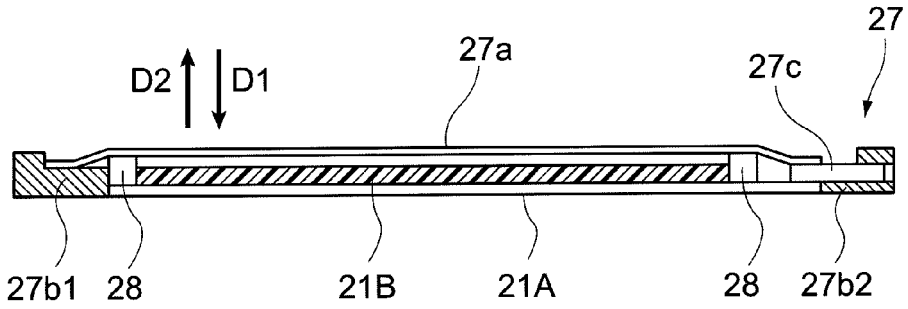
FIGS. 8A to 8C are schematic configuration diagrams showing a push-up unit according to a modified example of the exemplary embodiment.
Figure 8B:
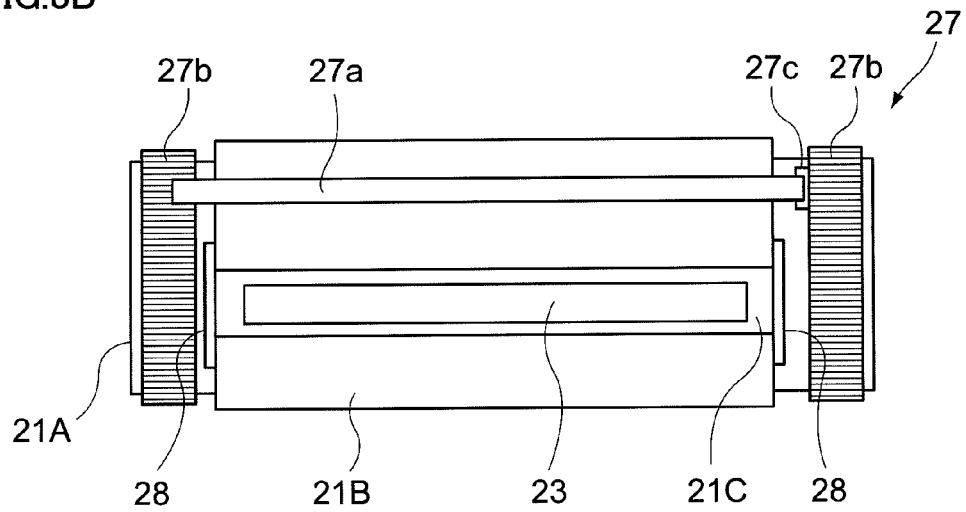
Figure 8C:
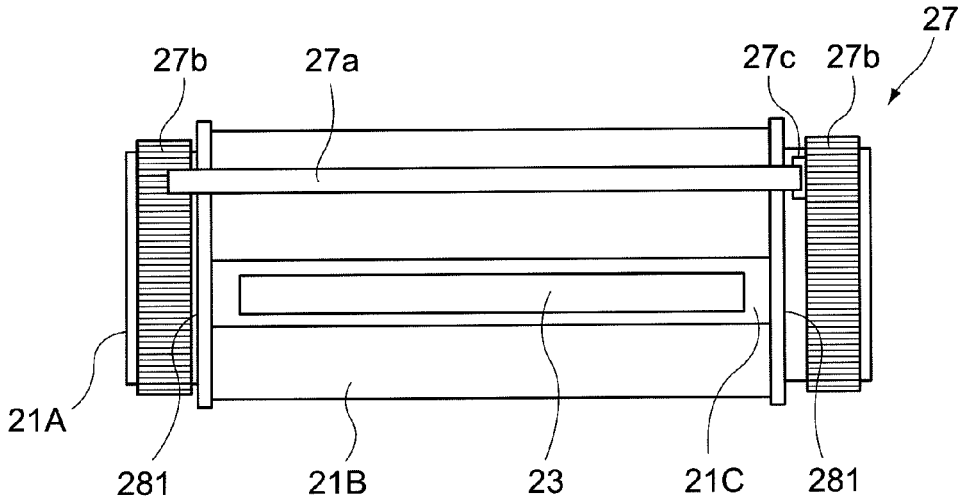

Here, with reference to FIGS. 8A to 8C, a modified example of the exemplary embodiment will be described. FIGS. 8A to 8C are schematic configuration diagrams showing a push-up unit 28 according to the modified example of the exemplary embodiment.

As shown in FIGS. 8A to 8C, the push-up unit 28, which is an example of a pressing unit, is a rectangular elastic member. The push-up unit 28 is provided on an outer circumferential surface of the base portion 21A in the transfer drum 21, and pushes up the sheet restriction unit 27*a* in the direction away from the outer circumferential surface of the transfer drum 21.

As shown in FIG. 8B, the push-up unit 28 is provided so that the longitudinal direction thereof is along the circumferential direction of the transfer drum 21. In the modified example, the push-up unit 28 is arranged in a part in the circumferential direction of the transfer drum 21 where the exposure portion 21C exists.

Further, the push-up unit 28 is provided to sandwich the elastic layer 21B at both ends thereof in the axial direction of the transfer drum 21. More specifically, the push-up unit 28 is provided outside the elastic layer 21B and inside the rotating unit 27*b* in the axial direction of the transfer drum 21.

Moreover, the push-up unit 28 is higher than the elastic layer 21B in the height from the base portion 21A toward the outer circumferential surface. For example, the push-up unit 28 is 1 mm to 2 mm higher than the elastic layer 21B.

The push-up unit 28 is made of rubber such as polyurethane, chlororprene, EPDM (ethylene propylene rubber) and NBR (nitrile-butadiene rubber), for example.

When the trailing edge gripper 27 arrives at the push-up unit 28 with the rotation around the transfer drum 21, the sheet restriction unit 27*a* of the trailing edge gripper 27 runs on an outer circumferential surface of the push-up unit 28 (refer to FIG. 8A). In other words, the sheet restriction unit 27*a* comes to a state of being supported by the push-up unit 28.

If the trailing edge gripper 27 is opened in the state where the sheet restriction unit 27*a* is running on the outer circumferential surface of the push-up unit 28, the push-up unit 28 pushes up the sheet restriction unit 27*a*. That is, the push-up unit 28 holds the sheet restriction unit 27*a* so that the sheet restriction unit 27*a* bends in the direction away from the elastic layer 21B.

On the other hand, if the trailing edge gripper 27 is closed in the state where the sheet restriction unit 27*a* is running on the outer circumferential surface of the push-up unit 28, the sheet restriction unit 27*a* comes to a state of receiving a tension without bending, thereby compressing the push-up unit 28. Consequently, though in the state where the sheet restriction unit 27*a* of the trailing edge gripper 27 is running on the push-up unit 28, the trailing edge gripper 27 is closed to hold the sheet S with the elastic layer 21B.

In other words, the push-up unit 28 has elasticity to the extent that the trailing edge gripper 27 is closed to hold the sheet S with the elastic layer 21B though in the state where the sheet restriction unit 27*a* of the trailing edge gripper 27 is running on the push-up unit 28.

The push-up unit 28 pushes up the sheet restriction unit 27*a* in the direction away from the elastic layer 21B, thereby suppressing bending of the sheet restriction unit 27*a* in the direction approaching the elastic layer 21B when the trailing edge gripper 27 is opened. This suppresses damage to the sheet restriction unit 27*a* due to the contact with the sheet restriction unit 27*a* by the leading edge gripper 23 and the elastic layer 21B which move with the rotation of the transfer drum 21.

Here, in the modified example, there has been description that the push-up unit 28 is provided on both sides of the elastic layer 21B in the axial direction of the transfer drum 21 to sandwich the elastic layer 21B, but is not limited thereto. For example, the push-up unit 28 may be configured to be provided only on one side of the elastic layer 21B.

Further, there has also been description that the push-up unit 28 is provided in the part in the circumferential direction of the transfer drum 21 where the exposure portion 21C exists, but is not limited thereto. For example, as shown in FIG. 8C, a push-up unit 281 may be configured to be provided all around the base portion 21A of the transfer drum 21.

<Other Modified Examples>

Figure 9A:
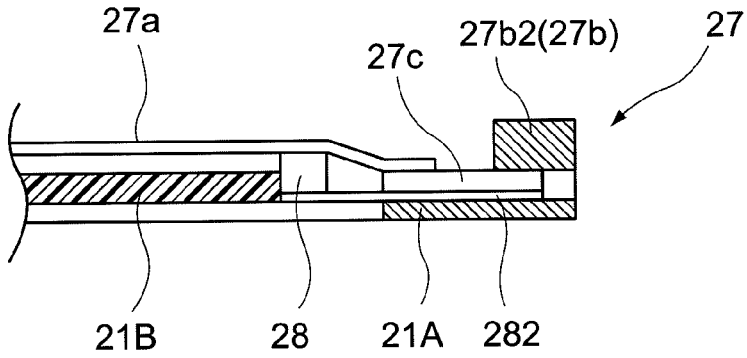
FIGS. 9A and 9B are schematic configuration diagrams showing other modified examples of the exemplary embodiment.
Figure 9B:
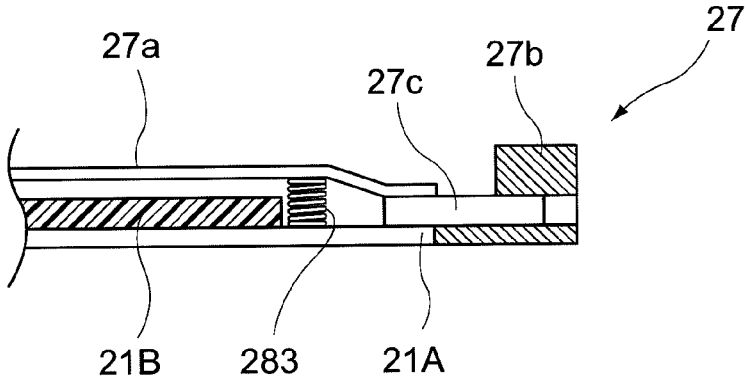

Here, with reference to FIGS. 9A and 9B, other modified examples of the exemplary embodiment will be described. FIGS. 9A and 9B are schematic configuration diagrams showing the other modified examples of the exemplary embodiment.

<Trailing Edge Gripper Holding Member 282>

As a modified example of the exemplary embodiment, the configuration in which the push-up unit 28 is provided has been described. Here, if the trailing edge gripper 27 is configured to pass over the push-up unit 28, friction occurs between the trailing edge gripper 27 and the push-up unit 28. On the other hand, occurrence of the friction between the trailing edge gripper 27 and the push-up unit 28 may be avoided by operating the push-up unit 28 together with the trailing edge gripper 27. Hereinafter, a configuration example for achieving this will be described.

As shown in FIG. 9A, a trailing edge gripper holding member 282 is a cylindrical member that is provided to an inner circumference of the rotating unit 27*b* (the first rotating unit 27*b*1 and the second rotating unit 27*b*2) and rotates around the transfer drum 21 with the rotating unit 27*b*. In this modified example, the push-up unit 28 is provided on an outer circumferential surface of the trailing edge gripper holding member 282. Consequently, the push-up unit 28 rotates around the transfer drum 21 with the trailing edge gripper 27.

Here, description will be given to a case where the push-up unit 28 is provided on the base portion 21A of the transfer drum 21, which is different from this modified example. In this case, if one of the transfer drum 21 and the trailing edge gripper 27 stops and the other rotates, the sheet restriction unit 27*a* of the trailing edge gripper 27 and the push-up unit 28 contact each other each time the one makes a single rotation. When the sheet restriction unit 27*a* and the push-up unit 28 are brought into contact, a load applied to the trailing edge gripper driving unit (not shown) that rotationally drives the trailing edge gripper 27 or the transfer drum driving unit (not shown) that rotationally drives the transfer drum 21 fluctuates (increases).

Next, description will be given to a case where the push-up unit 28 is configured to be provided to the trailing edge gripper holding member 282 to rotate around the transfer drum 21 with the trailing edge gripper 27, as in this modified example. In this case, the state of contact between the push-up unit 28 and the sheet restriction unit 27*a* does not change (the state where the push-up unit 28 and the sheet restriction unit 27*a* are in contact with each other is maintained) though one of the transfer drum 21 and the trailing edge gripper 27 stops and the other rotates. Accordingly, fluctuation in the load applied to the trailing edge gripper driving unit (not shown) or the transfer drum driving unit (not shown) is reduced compared to the case where the push-up unit 28 is provided to the base portion 21A of the transfer drum 21.

<Spring Member 283>

In the above-described example, the push-up unit 28 has been described to be the rectangular elastic member, but is not limited thereto. For example, as shown in FIG. 9B, a coil spring may be used as the push-up unit 28. Or, a plate spring may be used as the push-up unit 28.

<Movement of Rotating Unit 27*b*>

In the exemplary embodiment, the sheet restriction unit 27*a* is configured to be bent by the movement of the operating piece 27*c* along the axial direction of the transfer drum 21, but is not limited thereto. For example, the sheet restriction unit 27*a* may be configured to be bent by moving forward or backward any one of the first rotating unit 27*b*1 and the second rotating unit 27*b*2 with respect to the other so as to increase or decrease the distance between the first rotating unit 27*b*1 and the second rotating unit 27*b*2, without providing the operating piece 27*c*. Or, the sheet restriction unit 27*a* may be configured to be bent by moving forward or backward both of the first rotating unit 27*b*1 and the second rotating unit 27*b*2.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that is rotatably arranged and carries an image on an outer circumferential surface thereof;

a transfer member that is rotatably arranged to face the image carrier and transfers the image carried on the image carrier onto a sheet held between the transfer member and the image carrier;

a leading edge gripping member that is secured to the transfer member and grips a leading edge side of the sheet in a transport direction thereof on an outer circumferential surface of the transfer member, the sheet being supplied toward the transfer member; and a trailing edge holding member that is arranged to be rotatable around the transfer member and holds a trailing edge side of the sheet in the transport direction thereof between the trailing edge holding member and the outer circumferential surface of the transfer member, the sheet being supplied toward the transfer member, the trailing edge holding member bending to release the trailing edge side of the sheet, which has been held, in the transport direction thereof.

2. The image forming apparatus according to claim 1, wherein the trailing edge holding member bends by being pressed in a direction along a rotational axis of the transfer member.

3. The image forming apparatus according to claim 1, further comprising a pressing unit that is arranged between the trailing edge holding member and the outer circumferential surface of the transfer member, and presses the trailing edge holding member in a direction away from the outer circumferential surface of the transfer member.

4. The image forming apparatus according to claim 2, further comprising a pressing unit that is arranged between the trailing edge holding member and the outer circumferential surface of the transfer member, and presses the trailing edge holding member in a direction away from the outer circumferential surface of the transfer member.

5. A transfer device comprising:

a transfer member that is rotatably arranged to face an image carrier and has a cutout portion formed by cutting a part of an outer circumferential surface of the transfer member, the transfer member transferring an image carried on the image carrier onto a sheet held between the transfer member and the image carrier;

a leading edge gripping member that is provided to the cutout portion of the transfer member and grips a leading edge side of the sheet in a transport direction thereof on the outer circumferential surface of the transfer member, the sheet being supplied toward the transfer member; and a trailing edge holding member that is arranged to be rotatable around the transfer member and holds a trailing edge side of the sheet in the transport direction thereof between the trailing edge holding member and the outer circumferential surface of the transfer member, the sheet being supplied toward the transfer member, the trailing edge holding member being pressed in a direction along a rotational axis of the transfer member and bending in a direction away from the outer circumferential surface of the transfer member to release the sheet having been held.

* * * * *